US011643868B2

(12) United States Patent
Nitidharmatut

(10) Patent No.: US 11,643,868 B2
(45) Date of Patent: May 9, 2023

(54) HOUSEHOLD DOOR WITH INTEGRATED DISPLAY AND VARIOUS POWER ROUTING CONDUITS

(71) Applicant: Trysit Nitidharmatut, Bangkok (TH)

(72) Inventor: Trysit Nitidharmatut, Bangkok (TH)

( * ) Notice: Subject to any disclaimer, the term of this patent is extended or adjusted under 35 U.S.C. 154(b) by 129 days.

(21) Appl. No.: 17/369,153

(22) Filed: Jul. 7, 2021

(65) Prior Publication Data

US 2023/0010220 A1 Jan. 12, 2023

(51) Int. Cl.

| | |
|---|---|
| ***E06B 7/28*** | (2006.01) |
| ***E05D 11/00*** | (2006.01) |
| ***E06B 1/52*** | (2006.01) |
| ***E06B 3/74*** | (2006.01) |

(52) U.S. Cl.

CPC ..... *E06B 7/28* (2013.01); *E05D 11/0081* (2013.01); *E06B 1/52* (2013.01); *E06B 3/74* (2013.01); *E05Y 2400/612* (2013.01); *E05Y 2400/814* (2013.01); *E05Y 2400/818* (2013.01)

(58) Field of Classification Search

CPC ..... E06B 7/28; E06B 1/52; E06B 3/74; E06B 2009/2464; E06B 5/164; E05D 11/0081; E05Y 2400/612; E05Y 2400/814; E05Y 2400/818; F25D 2400/361; F25D 2400/36; H04N 7/186

See application file for complete search history.

(56) References Cited

U.S. PATENT DOCUMENTS

| | | | | |
|---|---|---|---|---|
| 4,404,813 | A * | 9/1983 | Paddock | F25D 29/005 374/208 |
| 7,319,407 | B2 * | 1/2008 | Jang | F25D 29/005 340/580 |
| 9,504,338 | B2 | 11/2016 | Artwohl et al. | |
| 9,664,435 | B2 | 5/2017 | Sung et al. | |
| 10,514,722 | B1 * | 12/2019 | Artwohl | H05K 5/0017 |
| 10,721,443 | B1 * | 7/2020 | Assani | G07C 9/00182 |
| 2001/0052741 | A1 * | 12/2001 | Yun | F16M 11/10 312/405 |
| 2006/0145576 | A1 * | 7/2006 | Lee | F25D 29/005 312/406 |
| 2012/0285089 | A1 * | 11/2012 | Artwohl | A47F 3/0434 49/70 |
| 2013/0063326 | A1 * | 3/2013 | Riegel | H04N 5/64 345/4 |
| 2013/0271696 | A1 * | 10/2013 | Dunn | G09G 3/18 349/58 |
| 2014/0001878 | A1 * | 1/2014 | Meyer | H01F 38/18 307/104 |

(Continued)

FOREIGN PATENT DOCUMENTS

JP 6525942 B2 6/2019

*Primary Examiner* — Brent W Herring

(74) *Attorney, Agent, or Firm* — Daylight Law, P.C.

(57) ABSTRACT

A household door with an integrated display, and methods for fabricating, installing, and routing power and data to the same are disclosed. The household door includes a door core having a cavity. The household door further incudes a front skin affixed to the door core and having a display window, and a back skin affixed to the door core. The household door further includes a display secured within the cavity and exposed by the display window. The front skin, the back skin, and the display seal the cavity.

23 Claims, 8 Drawing Sheets

(56) References Cited

U.S. PATENT DOCUMENTS

| | | | | |
|---|---|---|---|---|
| 2015/0130287 | A1* | 5/2015 | Steudtner | E06B 7/28 307/104 |
| 2015/0335174 | A1* | 11/2015 | Artwohl | G02F 1/1313 349/1 |
| 2015/0366083 | A1* | 12/2015 | Dunn | H04N 17/004 349/1 |
| 2018/0051509 | A1* | 2/2018 | German | E06B 7/28 |
| 2020/0043271 | A1* | 2/2020 | Anderson | H04B 1/04 |
| 2020/0265662 | A1* | 8/2020 | Maiga | G07C 9/00174 |
| 2020/0300031 | A1* | 9/2020 | Sullivan | E06B 5/161 |
| 2020/0304759 | A1* | 9/2020 | Berkeley | H04R 1/02 |
| 2022/0132073 | A1* | 4/2022 | Berkeley | H04N 23/57 |
| 2022/0263297 | A1* | 8/2022 | Bodurka | H02G 3/04 |

* cited by examiner

HOUSEHOLD DOOR WITH INTEGRATED DISPLAY AND VARIOUS POWER ROUTING CONDUITS

BACKGROUND

Displays are widely used in many scenarios of daily life, either for informative, educational, professional or personal purposes. With the surge of devices that include interactive displays, such as touch screen displays, the functionality and use of such devices has increased drastically. For example, fitness screens, smart mirrors, and similar devices have been gaining popularity among users. Placement of those devices is an important factor to consider because of the considerable space that needs to be allocated, especially when considering the space necessary to interact with the device. Flat displays and wall mounting devices have made the space for the device somehow negligible, but the area consumed by needing to interface with the device is still a constraint.

SUMMARY

Methods and systems related to the field of integrated displays are disclosed herein. Specific embodiments of the present invention relate to a display integrated with a door. The door can be a household door. Specific embodiments of the invention provide significant advantages in that the configurations disclosed can contribute to space savings and better use of space, by enabling the use of the area needed to open the door, such as the area where the door swings, which is an area that is always available but would otherwise be underused.

While hanging a display on the door can be a possible configuration, it is unlikely that such configuration will be successfully used because of the risks involved for the display. As the door is a movable structure, that in many cases hits walls or is heavily handled by users, a display hung thereon would not be protected enough to resist the average use of a door, such as a household door. Furthermore, power and data routing may not be easily addressed by such configuration, as cords and connections would be exposed from the display up to the power and/or data source, which can have a bad aesthetic appearance and interfere with the use of the door, or even be risky because the cords could get stuck or be inadvertently pulled by users, which can cause the display to be pulled out of the mounting structure on the door. Additionally, a display hung on a door will still consume an area beyond the surface of the door, which can be a constraint, even if the display is flat, as doors are often placed in corners and are nearly flush with the wall when completely opened.

Specific embodiments of the invention provide a solution that addresses the above-mentioned concerns, by integrating the display with the door via the internal structure of the door itself. In this way, a more robust configuration can be obtained than simply hanging a display on an existing door. Various advantages can be obtained from such configuration such as the fact that the display can be better protected by being housed by the core of the door, does not extend from the surface of the door and can instead be flush with the door, and power/data routing can be handled more efficiently. In specific embodiments of the invention, integrating a display and related components with a door can be achieved by modifying the internal structure of the door, either during the manufacturing process or by performing structural modifications on existing doors. In specific embodiments of the invention, the methods and systems disclosed herein enable this functionality with minimal adjustments to the existing doors and frames, and to the manufacturing methods used to produce doors at large scale.

In specific embodiments of the invention, a household door is disclosed. The door includes a door core having a cavity, a front skin affixed to the door core and having a display window, a back skin affixed to the door core, and a display secured within the cavity and exposed by the display window. The front skin, the back skin, and the display seal the cavity.

In specific embodiments of the invention, a household door installed in a door frame is provided. The door installed in a door frame includes a door core having a cavity, a door stop of the door frame, a set of hinges attaching the door core to the door stop, a front skin affixed to the door core and having a display window, a back skin affixed to the door core, a display secured within the cavity and exposed by the display window. The front skin, the back skin, and the display seal the cavity.

In specific embodiments of the invention, a method is provided. The method includes adhering a front skin, having a display window, to a door core, and adhering a back skin to the door core. The door core includes a cavity and a display secured within the cavity. The display is exposed by the display window. The front skin, the back skin, and the display seal the cavity.

DETAILED DESCRIPTION

Methods and systems related to the field of integrated displays in accordance with the summary above are disclosed in detail herein. Specific embodiments of the present invention relate to a display integrated with a door. The door can be a household door or any other door. The door can have a distinctive structure to receive and house the display and associated components, and to allow for power and data to be routed to the display.

Figure 1:
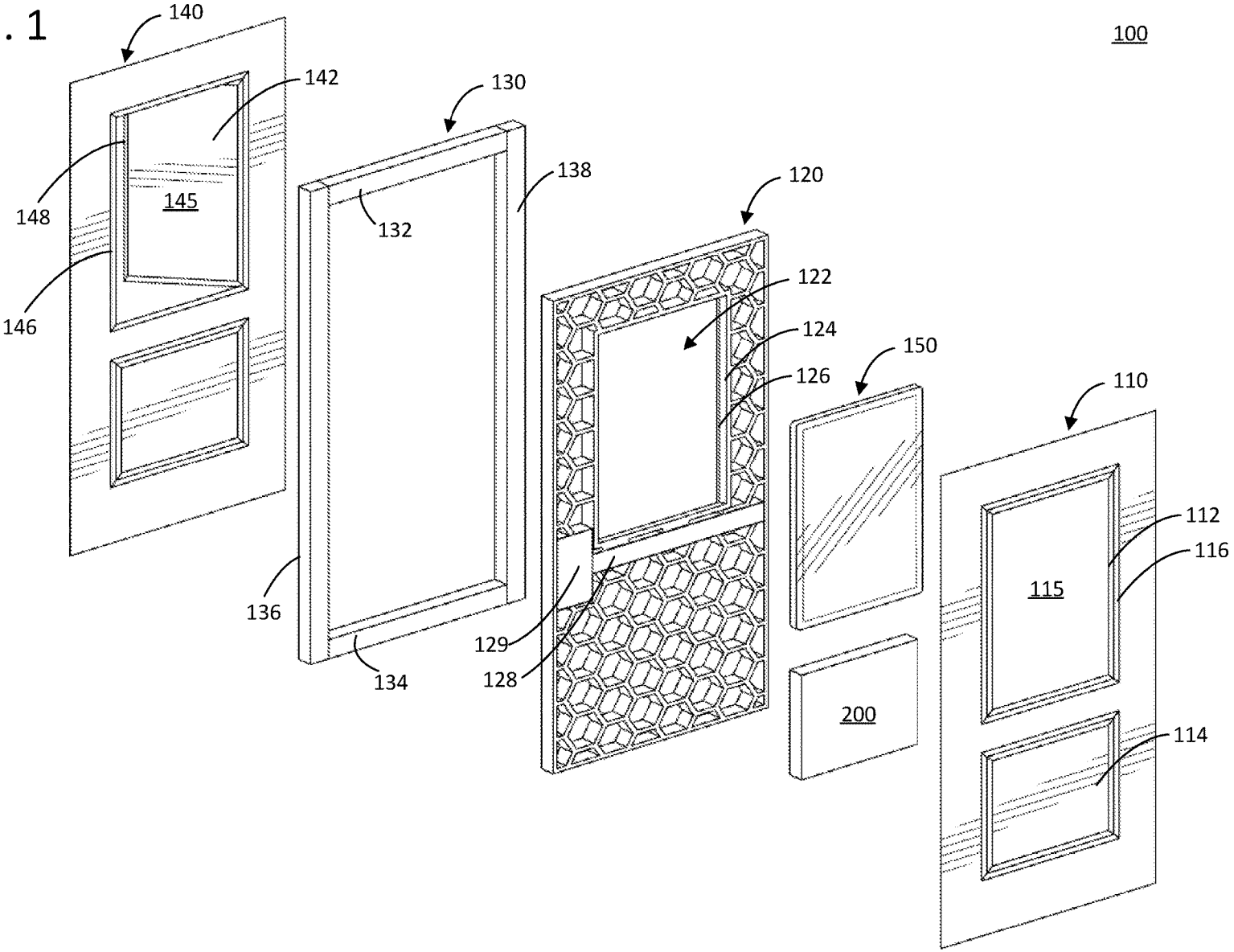
FIG. 1 includes an exploded diagram of a door in accordance with specific embodiments of the invention disclosed herein.

FIG. 1 includes an exploded diagram of a door 100 in accordance with specific embodiment of the invention disclosed herein. The exploded diagram illustrates exemplary parts of the door 100 that include a front skin 110, a core 120, a core frame 130, and a back skin 140. The exploded diagram also illustrates a display 150 and a components block 200. The components block 200 can represent a single block of components such as electric and electronic components or various independent devices or components. The components block 200 can be integrated with the display 150 or provided separately and be otherwise connected to the display 150. The components block 200 can be entirely housed by the door 100 or include remote components that are not necessarily located within the door.

The core 120 provides the internal structure of the door. The core can be of various materials, shapes, and patterns. The core can be a hollow core or a solid core, or a combination thereof in the form of different patterns. In the example illustrated in FIG. 1, the core 120 has a honeycomb pattern so that it is a semi-hollow core. This core structure can be advantageous in that it can be less heavy than a solid core while at the same time providing strength and protection to the door. Other patterns are possible such as squared, diagonal, diamond shape, or any other regular or irregular shape. The core can also be a solid core. The material of the core can be solid wood or wood derived or wood engineered material such as fiberboard such as low-density fiberboard (LDF), medium-density fiberboard (MDF) high-density fiberboard (HDF) or hardboard, plywood, pressboard, particle board, flakeboard, glued laminated timber, pressed wood, and the like.

The core can be formed or cut to have one or more cavities, such as cavity 122. The cavity can be shaped to accommodate a display such as display 150, and other elements such as components block 200. The cavity can have various shapes and be at different positions in the core. In the illustrated example, the cavity 122 is located on the top area of the core and shaped so that a front side 124 of the cavity has dimensions around the size of the display so that the cavity can house the display 150. In specific embodiments of the invention the back side 126 of the cavity can be larger than the front side 124. This can be advantageous in that the components to be placed in the cavity, such as display 150, can be placed from the back more comfortably without being limited in movement. This configuration can also be advantageous in that other components, such as all or part of the components block 200, can be placed on the back side of the cavity. In this way, the front side of the core can house the display flush with the surface and surrounded by the edges of the cavity while still providing space for adjusting and/or operating the display and components from the back side.

The core 120 can include a core frame 130. The core frame 130 can surround the core and still be internal to the door in that it is not visible once the door is assembled (with the skins placed on). The core frame can include various rails, such as top rail 132 and bottom rail 134, and various stiles, such as side stiles 136 and 138. The core frame can include additional rails and stiles such as intermediate rails and stiles. The core 120 can then be formed by various sections that fit in between the rails/stiles or by a unitary section where the rails/stiles can be accommodated. The core frame 130, rails and/or stiles (132, 134, 136, 138) can be used for different purposes such as to provide structure to the core. In specific embodiments of the invention, the frame, rails and/or stiles can be of the same material as the core, the same material of the skins, or other material. In specific embodiments of the invention, the core frame 130, rails and/or stiles (132, 134, 136, 138) are solid wood, engineered wood, wood imitation, metal, or any other suitable material.

In specific embodiments of the invention, the core 120 can include a lock support. The lock support can be any structure suitable for installing a lock of the door, such as locks rail, a lock block, etc. In the example of FIG. 1, a lock support is illustrated in the form of a lock rail 128. In embodiments in which the cavity 122 is in an upper position on the core 120 and the core includes a lock rail 128, the cavity 122 can be above the lock rail 128 and the display 150 can be supported by the lock rail, as illustrated in the example of FIG. 1. The example of FIG. 1 also illustrates a lock support in the form of a lock block 129, which can be of the same material of the core frame 130, rails and/or stiles and support a lock of the door. The lock support can be part of the core 120 itself or of the core frame 130.

The door skins, such as front skin 110 and back skin 140 can have various functions such as to cover the core, to seal the core, to protect the core, to provide a better aesthetic appearance to the door, etc. The door skins can be door veneers, which usually refer to thin layers of material, such as wood, that are layered over the core of the door. The skins can be of various materials, such as wood, engineered wood, wood imitation, metal, aluminum, steel, glass, porcelain stoneware, natural stone, plastic, polyester or other fabric, or any other suitable material that can be placed over the core.

The door skins, such as front skin 110 and back skin 140 can be affixed to the core 120 in various ways. For example, they can be attached via an adhesive substance. The adhesive substance can be any substance suitable for adhering the material of the core to the material of the skins. For example, if both the core and the skins are wood, the adhesive substance can be wood glue. Other substances are possible depending on the materials being used such as vinyl glue, plastic glue, etc. The skins can also be affixed to the core via other means such as by using nails, rivets, clips, double sided adhesives, and the like.

The door skins, such as front skin 110 and back skin 140 can be of various shapes. For example, the skins can be flat sheets of material that provide a smooth surface, or can be corrugated, ridged, channeled or of any other patterns or combination thereof. The skins can have additional features for structural or embellishment purposes. For example, the skins can have one or more panels, such as panels 112 and 114 illustrated in front skin 110 in FIG. 1. FIG. 1 illustrates an example in which both the front skin 110 and the back skin 140 have two panels, in this case a top panel 112 and a bottom panel 114. However, this is not a limitation of the present invention. The skins can have a single panel or multiple configurations of panels or can have no panels at all. The panels can be formed as part of the skins such as by molding or shaping the panels shape when the skin is being manufactured or be separate panels that can be affixed together to form the skin in various ways such as by gluing or nailing.

The panels can be delimited or formed by frames, such as frame 116. The frames can surround the area that forms the panels. The frames can protrude from the skins or be in the form of recesses on the skins. The frames can also be in the form of any specific pattern that differs from the panels and/or skins so that they delimit the panels when placed around them. The frames can be shaped into the skins or be provided separately. For example, the frames can be molded with the skins such as by designing the frame shape on the skins when the skins are being manufactured, or can be formed by separate pieces of material, such as wood, affixed to the skins around the panels to form the frame. The material of the frames can be the same as the skins or a different material. In specific embodiments of the invention, the frames are of solid wood. In other specific embodiments of the invention, the frame is of any wood engineered material, plastic, metal, or any suitable material.

The front skin, such as front skin 110, can have one or more windows such as window 115. The windows can expose part of the core or of the components within the core. In the example of FIG. 1, window 115 is a display window. Display window 115 can serve to expose display 150 housed within the cavity 122. The display window can be sized so that it has the same dimensions as the front side 124 of the cavity 122 in core 120. In this example, the display window can be sized so that it has the dimensions of the display. The display window can be completely cut open or have a closing structure such as a slidable or retractable door, a hinged tab, or the like so that the display can be visible when the window is open but covered when the window is closed. In embodiments in which the skins have panels, the display window can be formed in one of the panels. In the example of FIG. 1, for example, display window 115 is formed in the top panel 112. In those embodiments, if the panels have a frame such as frame 116, the frame can protrude beyond the surface of the display. For example, the frame can be a solid wood frame affixed to front skin around the top panel, so that it surrounds the display and protrudes beyond its surface. These embodiments can be advantageous in that a display with a protruding frame can be better protected than a display placed flat with the skin of the door in scenarios such as when the door hits a wall when opened.

The back skin, such as back skin 140, can likewise have one or more windows such as window 145. The windows can expose part of the core or of the components within the core. In the example of FIG. 1, window 145 is an access window. Access window 145 can serve to expose the back of display 150 housed within the core 120 or other components housed by the cavity, such as the other components block 200. The access window can be sized so that it has the same dimensions of the back side 126 of the cavity 122 in core 120. In specific embodiments of the invention and as illustrated in the example of FIG. 1, the access window 145 can be sized so that it is larger than the display window 115 on the front skin 110. These embodiments can be advantageous in that the display or any other components to be placed in the core can be comfortably placed with room for maneuvers and handling.

The access window can be completely cut open or have a closing structure such as a removable door 148, a hinged door, a slidable door, a retractable door, or the like so that access to the interior of the door is possible when the window is open but not when the window is closed. In this way, the access window can provide access to the cavity in a first position and seal the cavity in a second position. In embodiments in which the skins have panels, the access window can be formed in one of the panels. In the example of FIG. 1, for example, the access window 145 can be formed in the top panel 142 of the back skin 140. In those embodiments, the panel where the access window is formed can be an access panel and provide access to the cavity in a first position (such as when window 145/panel 142 is open) and seal the cavity in a second position (such as when window 145/panel 142 is closed). In those embodiments, if the panels have a frame, such as frame 146, the frame can protrude beyond the surface of the access window.

In specific embodiments of the invention, a second display can also be placed within the cavity, for example facing the back of the door. In those embodiments, the cavity 122 can house both displays and the access window 145 can be a second display window, such as display window 115. Each display can face an opposite side of the door and be interconnected so that two users can interact simultaneously while being physically separated by the door. Those embodiments can be advantageous for example in professional settings for a collaborative work experience, for meeting social distance guidelines, for gaming, and the like. Two or more displays can be used on either side of the door. For example, a door can have various display windows on the same side, or a large display window exposing various displays, so that different information and/or interaction can be provided by each display at once. Dedicated cavities, such as cavity 122, for each display can be provided on the core of the door.

The display 150 can be any display available on the market, such as flat screen displays using Liquid Crystal Display (LCD) technology. In specific embodiments of the invention, the display is a light weight display so that no unnecessary weight is placed on the door, such as a Light Emitting Diode (LED) or micro LED display. In specific embodiments of the invention, the display is a touch display so that it can be used not only to display information but also to serve as a user interface. In specific embodiments of the invention, the display is an interactive display and includes user interfaces such as buttons or a remote controller (for example a gaming controller) for the users to interact with the display. The display can be of different sizes and occupy different areas on the door. For example, the display could occupy the majority of the door surface if it is desired to provide a large display such as a human-sized display. This can be advantageous for situations in which the display is used for exercising and gaming, for example. Alternatively, the display can occupy part of the door surface as illustrated in FIG. 1. All or part of the display can be a touch surface to enable interaction as described above.

Figure 2:
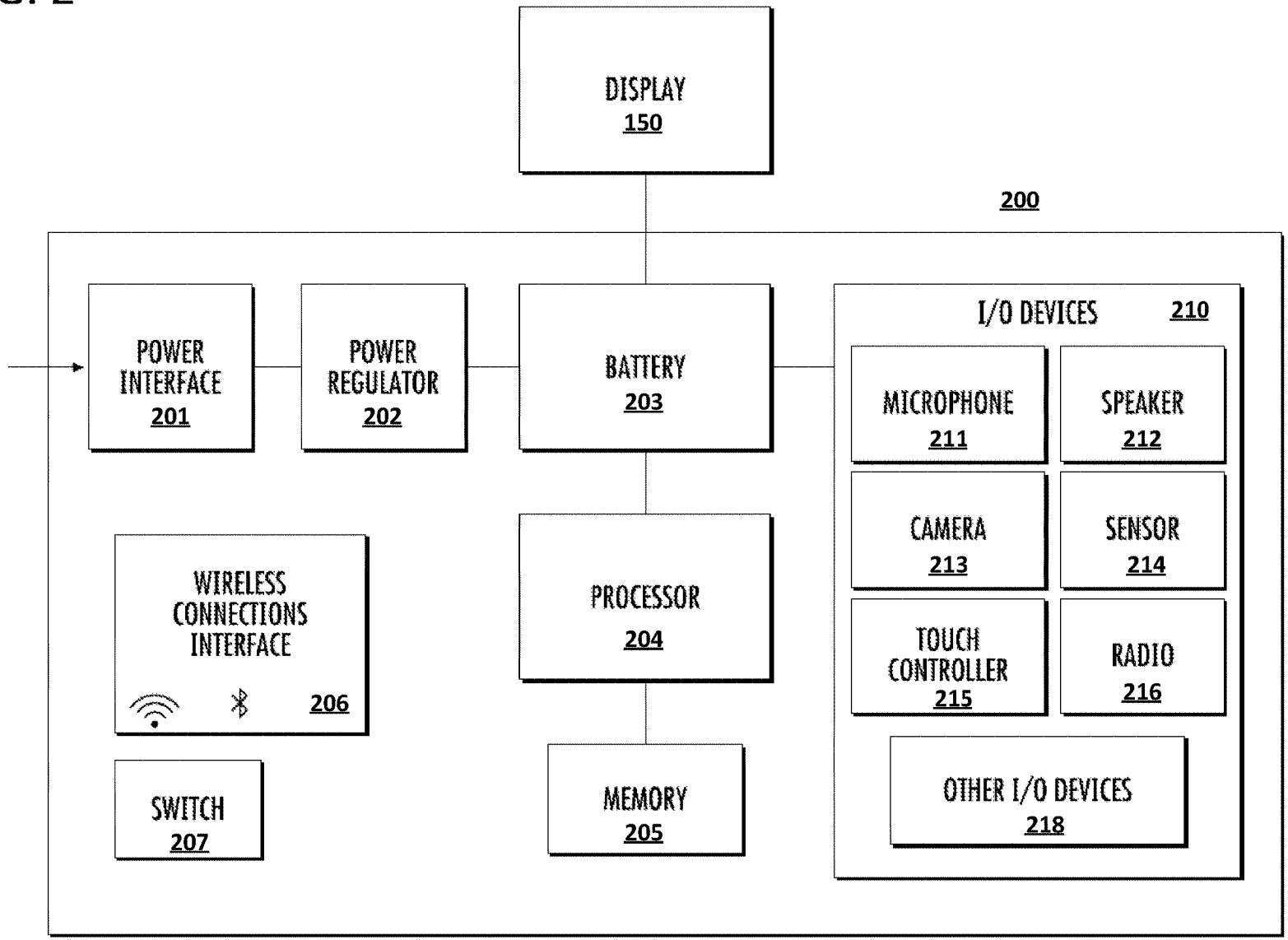
FIG. 2 includes a block diagram of exemplary components that can be integrated with the door of FIG. 1, in accordance with specific embodiments of the invention disclosed herein.

FIG. 2 illustrates a block diagram of exemplary components that can be integrated with the door of FIG. 1. The components illustrated in FIG. 2 can be part of a components block 200 also illustrated in FIG. 1. The components block 200 can be integrated with the display 150 or not. Although the components block 200 is illustrated as a single block, the components represented therein can be discrete components and be provided individually from each other. For example, the components can be provided in the form of peripherals or input/output (I/O) devices that are connected to a main hub via a peripherals or I/O interfaces. Alternatively, some of the components illustrated in the block diagram of the components block 200 can be integrated with the display while others can be interdependent to the display and be for example integrated with or otherwise connected to the door.

In specific embodiments of the invention, the door can include one or more processors, such as processor 204. The processor can be integrated with the door. For example, the processor can be integrated with the display 150 or otherwise be housed by the door such as in the cavity 122 and interconnected with the remaining components of the door. Alternatively, or in combination, the processor can be located remotely. For example, the processors can be the processor of a cellphone or computing device operating in association with the display and/or the door. In this way, the processing associated with the functions that the door provides can be performed internal to the door itself or externally via a connection, such as a wired or wireless connection, as will be described in more detail in this disclosure.

In embodiments in which the door and/or display include a processor, the processor can instantiate an operating system. The operating system can administrate various functions for the door and/or display. For example, the operating system can control and administrate the interoperability of the different components, instantiate software modules so that the components perform certain functions, administrate the tasks to be performed by the different components, etc. The operating system can also control peripherals and/or input/output devices. The operating system can also control the information associated with the display, such as the information to be displayed and information received, for example via touch coordinates in the case of a touch display. The processor can perform the aforementioned functions by accessing a memory, such as memory 205. The memory can be a memory internal to the processor or otherwise accessible to the processor so that data, such as software instructions, can be retrieved and or stored there.

In specific embodiments of the invention the door and/or display include one or more input/output devices 210. The input/output devices can include any device that serves to input and/or output information, including but not limited to a microphone 211, a speaker 212, a camera 213 such as a visible light camera, a sensor 214 such as a depth sensor, a radio 216, a touch controller 215 for the touch display or any other input/output controller. Other kinds of input/output devices 218 can also be integrated with the door and/or display depending on the desired functionality. For example, if the display is used for gaming, a gaming controller could be provided. Receivers such as dongles can also be added to provide further functionalities such as to connect a mouse, a game controller, a keyboard, or to provide internet access to the door and/or display.

The input/output devices can be integrated with the door or be peripheral devices that are connected to the door and/or display via a wired or wireless connection. For example, a camera can be integrated with the door in that it can be affixed in a dedicated cavity or window of the door core and/or skins. As another example, the door can include various ports such as Universal Serial Bus (USB) ports to which the I/O devices can be connected. The door can also be shaped so that it holds devices connected thereto such as a cellphone. For example, the door can include a phone stand next to a USB-C port so that the phone can be connected to the door and placed nearby.

The door can include one or more of the I/O devices described above and those devices can be placed anywhere around the door structure. For example, a door can include a camera on the alternative side of the display so that a user in the room facing the display can look at the room facing the camera. Similarly, the door can include cameras, microphones, and speakers on both sides so that two users in different rooms can interact with each other. This can be advantageous for exercising, gaming, and meetings. Various sensors can also be provided at any part of the door structure such as for body pose determination, presence determination, etc. For example, Light Detection and Ranging (LIDAR) sensors can be used to scan areas faced by the doors and provide a desired feedback such as imagined on the display or the like.

In specific embodiments of the invention, the door and/or display can include a wireless connection interface 206 for communication with other devices. For example, the wireless connection interface can provide the door with wireless functionalities such as WiFi and Bluetooth connectivity. In this way, the door can connect with other devices, have access to the Internet, etc. In specific embodiments, the I/O and peripheral devices described above can be connected to the door via the wireless connection interface. In specific embodiments of the invention, data and power can be supplied to the door via the wireless connections interface.

In specific embodiments of the invention, the door can also include one or more switches 207 to activate and deactivate certain components, such as the I/O devices, or turn the display off. The switch can be a mechanical switch, so that it mechanically switches off components connected thereto, or a logic switch, such as an interface on the touch display to turn off the display. The switch can be a privacy switch configured to mechanically cut power to certain components, such as the radio 216, camera 213, and microphone 211, such as a hard-wired radio power-off switch, a hard microphone-off switch, etc. This can be advantageous to avoid privacy concerns. Other solutions can also be provided for the same purpose such as placing a removable physical cover over the camera.

In specific embodiments of the invention, the door and/or display integrated with the door can include one or more batteries 203. The battery can power the different components of the door, such as display 150, processor 204, the integrated input devices 210, etc. In specific embodiments of the invention, the door and/or display can also include a power interface 201 and a power regulator 202 to provide power to the different components, including the display 150 and the battery 203. The power interface can be any interface that serves to receive and provide power to the components. For example, the power interface can be any interface between a power source and the door/display, such as a wire, a plug and socket combination, a wireless connection, a contact surface, etc. Various examples of power interfaces will be given with reference to the examples of FIG. 3-7. The power regulator can receive power from the power interface, or from the power source via the power interface, and provide power to the remaining components and/or the battery. The components, such as the display and I/O devices, can receive power from the power source, power interface, or power regulator directly or via the integrated battery 203.

Power and/or data can be routed to the door/display in various ways. The door can include internal means for the provision of power and data, such as battery 203 and memory 205, and be fed by external sources, such as an external power and/or data source, if needed. Various non-limiting examples will be given with reference to FIG. 3-7. Some examples describe power interfaces and others describe data interfaces. This differentiation is for exemplary purposes only. It is to be understood that similar approaches, connections, and interfaces can be used to route both power and data, and that they can be combined so that data is routed one way while power is routed in the same or different way for the same door configuration.

Figure 3:
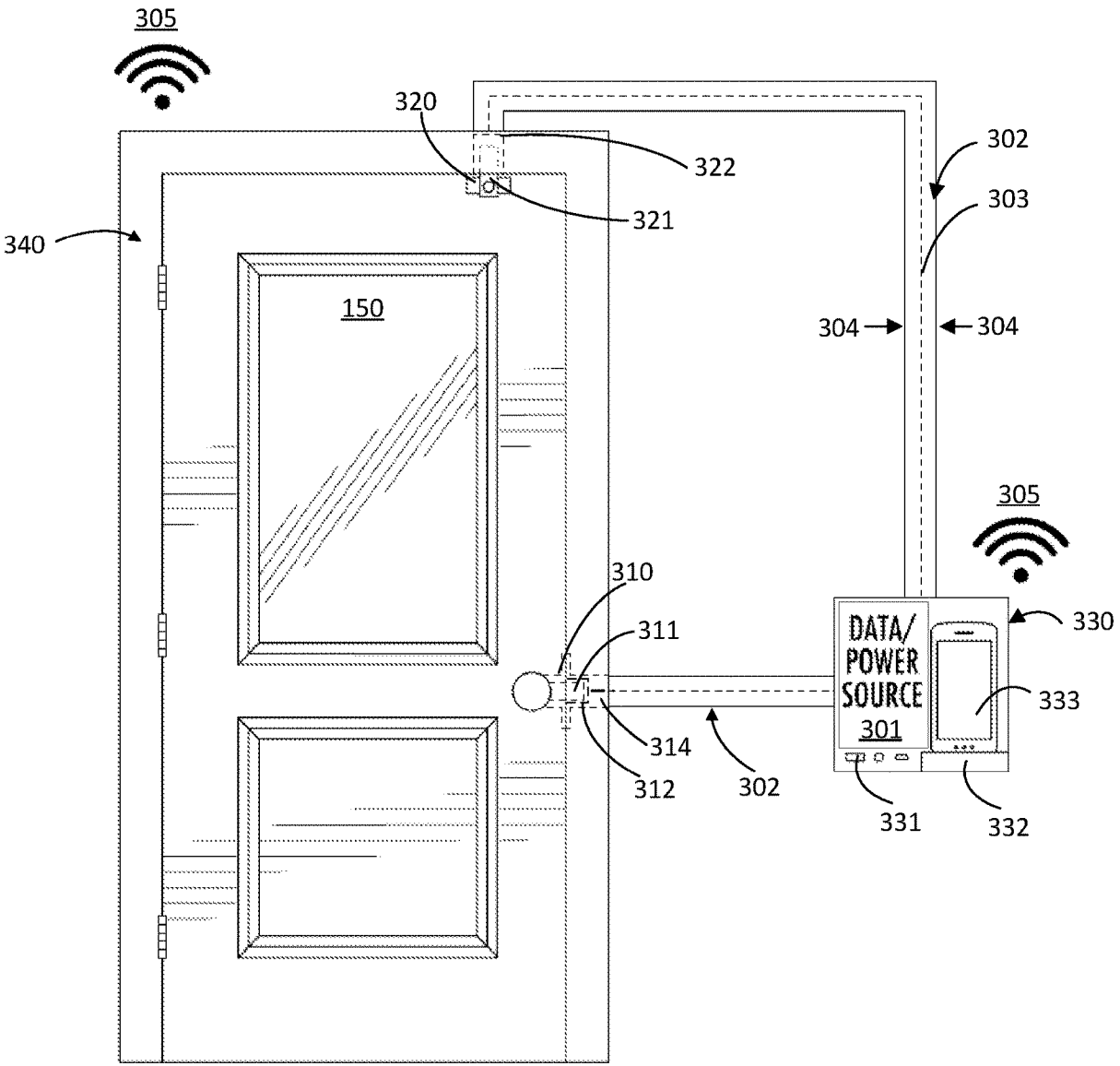
FIG. 3 includes an example of a door including power and/or data interfaces in the form of a deadlatch power interface and a frame recessed power interface, in accordance with specific embodiments of the invention disclosed herein.

FIG. 3 illustrates an example of a door including power interfaces in the form of a deadlatch power interface 310 and a frame power interface 320. The power interfaces can be configured to provide power to the display and the remaining components illustrated with reference to FIG. 2, including the battery 203, for example via the power regulator 202. The interfaces can be at different positions on the door and the illustrated examples are for explicative purposes only.

In the example of FIG. 3, the power/data source 301 can provide power/data to the door via physical connections, such as connections 302, to interfaces on the door frame 340, such as deadlatch box power interface 312 and frame recessed power interface 322, which can interface with the power and/or data interfaces on the door, such as 310 and 320, to provide power and/or data to the door, as will be described below. The physical connections 302 can be internal or external connections. For example, a wire 303 can connect an interface on the door frame, such as interfaces 312 and 322, with the power and/or data source 301. The wire can be an external wire or be internal to a wall such as for example via the electrical conduit 304 or other conduit. In specific embodiments of the invention, power and/or data can also be provided wirelessly via wireless connection 305.

In the example of FIG. 3, the power/data source is represented in the form of an external hub 330. However, the source can be an internal source and be hidden from the view of the users. For example, it can be the electric circuit of a house that powers an outlet for the door via conduits internal to the walls. The hub 330 can be a device affixed to the wall. The hub can include various ports 331 for connection of other devices such as USB ports, lighting ports or other ports. The hub can include a holder 332 for placing a personal user device such as a mobile phone 333. The holder 332 can include physical and/or wireless connections to the phone such that the phone can be connected to the door. The hub can be of the size of a light switch or wall socket and be placed at floor level or at a level that is convenient to the users to plug/unplug devices. The switch 207 described with reference to FIG. 2 can be located at the hub 330.

Deadlatch power interface 310 can include a conductive protrusion, such as protrusion 311, configured to receive power from a power interface located on the frame of the door, such as a deadlatch box power interface 312. A hole 314 can be provided through the frame 340 so that power and data from the source 301 can be routed through the hole. The deadlatch box 312 can be embedded in the frame and outline the door. The protrusion 311 can be a retractable sheathed conductive protrusion that comes in contact with the deadlatch box power interface 312. In this way, power can be provided from the power source 301 to the deadlatch box power interface 312 and from there to the deadlatch power interface 310 via the protrusion 311. The deadlatch power interface can alternatively include a deadlatch inductive power interface configured to receive power from a deadlatch box inductive power interface so that no physical contact is needed between the interfaces. In this example, the deadlatch power interface 310 is located on the knob of the door so that the power transfer could happen automatically whenever the door is closed. However, the deadlatch power interface can be located at any position around the door such that a dedicated latch can be used for power transfer. For example, power interface 320 could be a deadlatch power interface, where latch 321 could be positioned within a recess, such as frame recessed power interface 322, or latch box within the frame 340 when it is desired to provide power to the door.

In specific embodiments of the invention, the interface can be a deadbolt power/data interface, for example the retractable protrusion 311 can be a protrusion of a deadbolt that is locked when a certain mechanism is activated such as by turning a key or lock. The protrusion can include a data transfer interface, such as a USB plug, that can be connected to a data transfer port that receives the protrusion of the deadbolt, such as USB socket, so that data can be transferred when the deadbolt is in a locked position, and therefore the interfaces are connected.

Power interface 320 can be a frame power interface configured to receive power from a frame recessed power interface 322 when connected thereto. The frame power interface 320 can include a latch 321, as described with reference to the previous example, or any other structure that can be connected to the recess on the frame of the door. The frame power interface can be integrated with the door and provide power to the components of the door as described with reference to power interface 201 in FIG. 2. In specific embodiments of the invention, the latch or other retractable structure that forms the frame power interface can include a data transfer interface, such as a USB plug, that is connected to a data transfer port, such as a USB socket, so that data can be transferred when the interfaces are connected.

The examples explained with reference to FIG. 3 are illustrative of the possibilities to connect a data/power interface of the door to a data/power source via interfaces on the frame of the door. In both examples, the power/data interface of the door is a structure (protrusion, latch, etc.) that comes into proximity with an interface on the frame, which is in turn connected to the power/data source. In this way, the data/power interfaces of the door can be connected/disconnected at the user discretion by simply placing the structure in the "locked" position. Again, the interfaces can be placed at any position around the door and do not need to be associated to the door deadlatch or a latch for locking the door.

Figure 4:
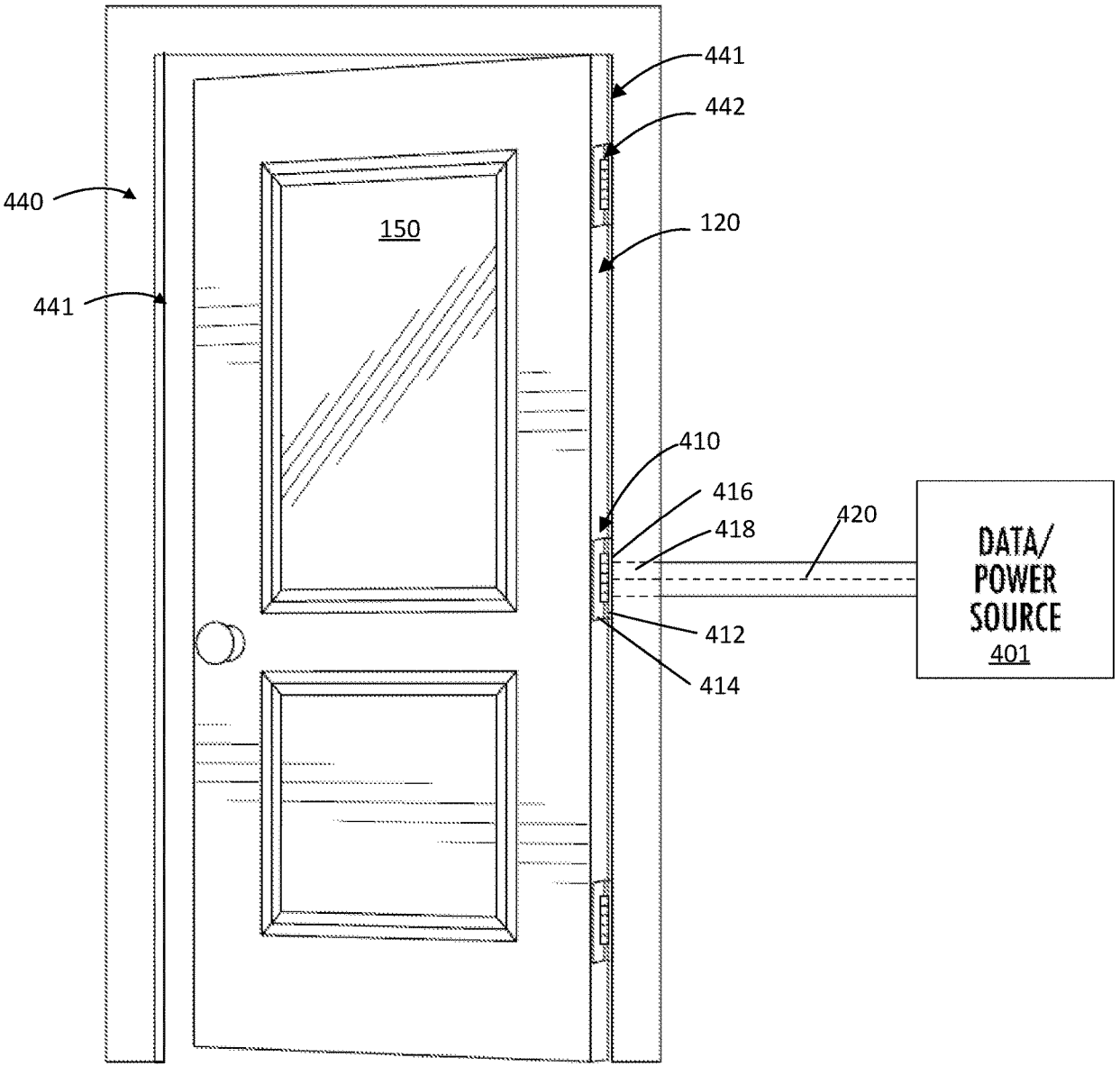
FIG. 4 includes an example of a door including a power and/or data interface in the form of a hinge power interface, in accordance with specific embodiments of the invention disclosed herein.

FIG. 4 illustrates door installed in a door frame 440. The frame 440 can include a door stop 441. The door can include one or more hinges 442 that attach the door to the frame 440 or to the door stop 441 by attaching a hinge leaf to the core 120 and the other hinge leaf to the door stop/frame. FIG. 4 illustrates an example of a door including a power interface in the form of a hinge power interface 410. Hinge power interface 410 includes a wall leaf 412 of the hinge, which is the leaf of the hinge attached to the wall and/or frame 440, and a door leaf 414 of a hinge, which is the leaf of the hinge that is attached to the door itself. The wall leaf 412 can be configured to receive power from a door frame power interface 416. For example, power can be provided from a power source 401 in a manner similar to the one described in FIG. 3 to the frame 440 of the door. A hole 418 can be provided through the frame 440 so that the cable 420 from the power source can be connect to the wall leaf 412 of the hinge via the door frame power interface 416. The interface 416 can be provided by attaching the wire cable 420 to the hinge leaf 412 by a conductive means such as soldering, via conductive glue or adhesives, etc. The door leaf 414 can be configured to receive power from the wall leaf 412 when the door leaf 414 and the wall leaf 412 are connected. The leaves can be connected via a conductive pin or another conductive structure such that power can flow between the leaves of the hinge.

Figure 5:
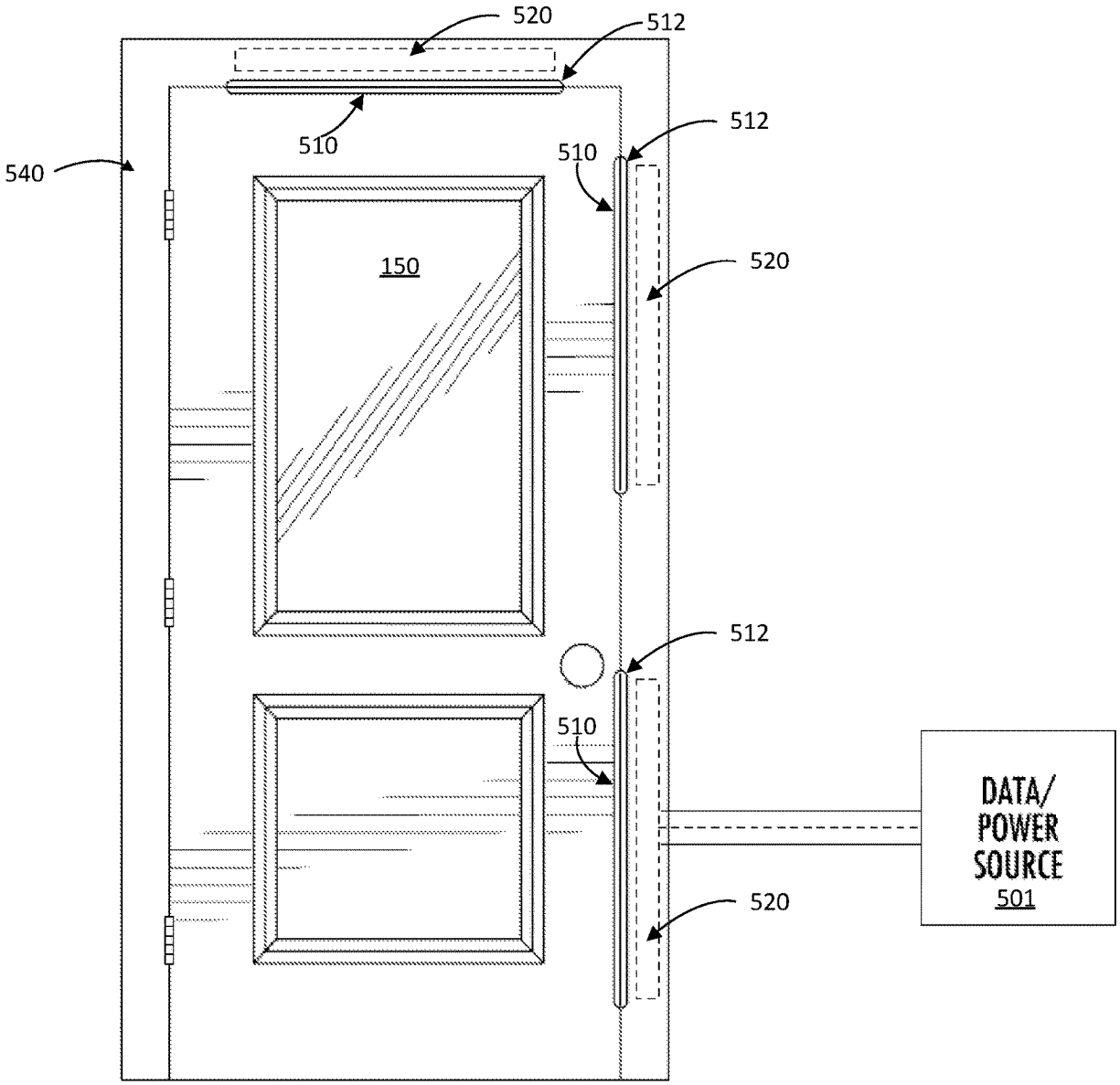
FIG. 5 illustrates an example of a door including a power and/or data interface in the form of an external frame power interface, in accordance with specific embodiments of the invention disclosed herein.

FIG. 5 illustrates an example of a door including a power interface in the form of an external frame power interface 510. In specific embodiments of the invention, the external frame 540 can be the part of the frame that surrounds the door when the door is closed. In specific embodiments of the invention, the external frame can be the part of the frame that is visible when the door is closed. The external frame power interface 510 can be configured to receive power from an external frame mounted power interface 512 when connected thereto. For example, the external frame power interface 510 and external frame mounted power interface 512 can be one or more conductive areas of the door and frame for transferring power when in contact with each other. Alternatively, the external frame power interface and external frame mounted power interface can be one or more inductive areas of the door and frame for transferring power when placed close to each other. The external frame mounted power interface 512 can be any mounted interface that receives power from a power source, such as power/data source 501, in the manner described above with reference to FIG. 3 and FIG. 4. In the example illustrated in FIG. 5, the external frame mounted power interfaces are in the form of multiple contact areas on the door, but this is not a limitation of the present invention and any structure that can be used for receiving charge from the frame can be used. For example, the external frame mounted power interface 512 can be a socket mounted on the frame, to which an external frame power interface in the form of a plug or cable can be connected. This and other configurations are possible.

The example of FIG. 5 also illustrates batteries 520 placed in the external frame 540. Those batteries can be internal or external to the frame. Those batteries can be the battery 203 of the door, described with reference to FIG. 2. Embodiments of the invention in which batteries are provided on the frame, as illustrated in the example of FIG. 5, can be advantageous in that the weight of the door can be reduced by placing heavy components such as the batteries on the frame. Power can be provided from the power source 501 to the batteries and then transferred to the door via the frame power interfaces described herein. In specific embodiments of the invention, the external frame mounted power interface 512 described herein can be provided by the batteries 520 themselves, so that the batteries receive power from an external source and transfer such power to the door.

Figure 6:
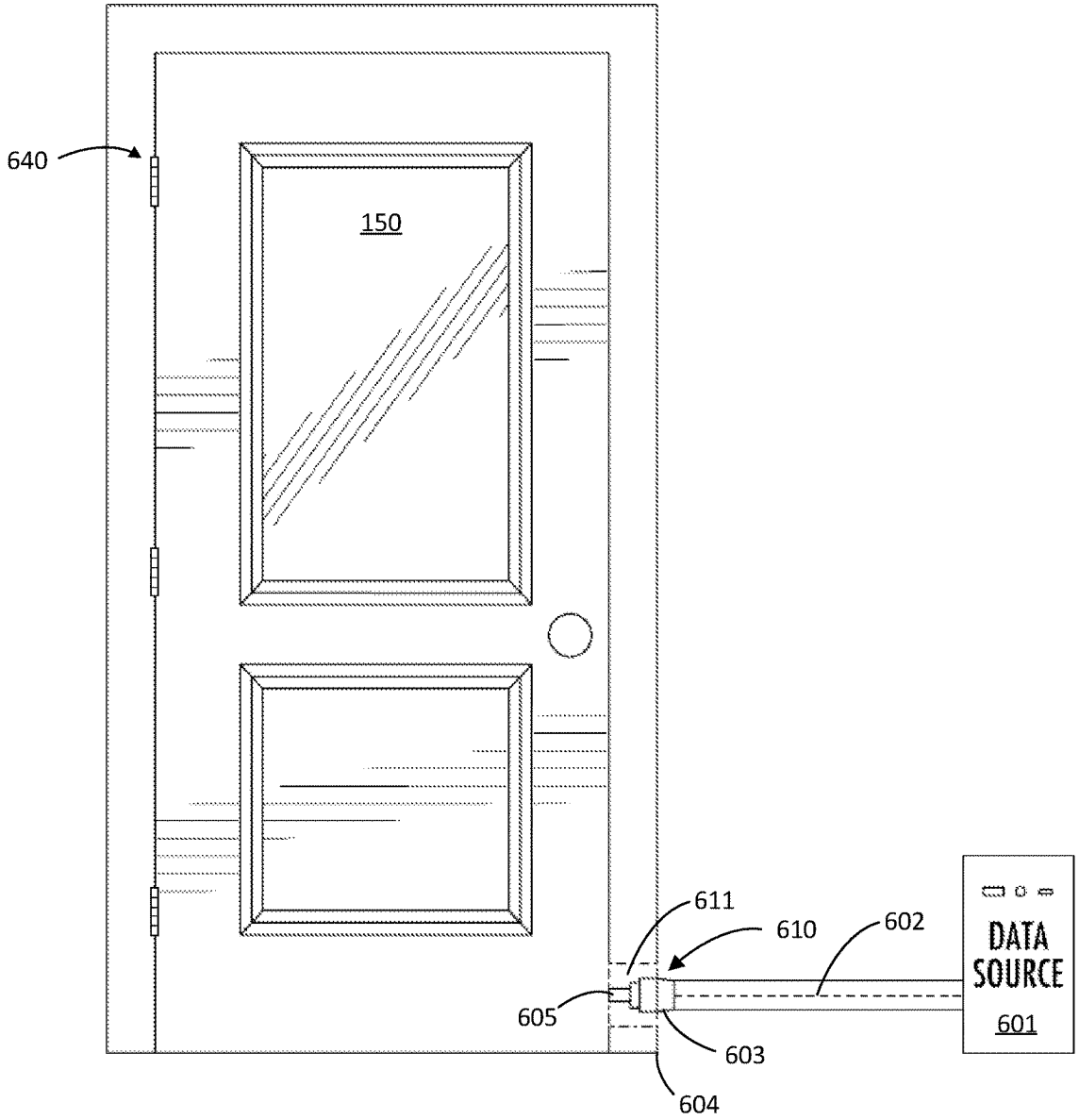
FIG. 6 illustrates an example of a door including a power and/or data interface using a socket connection, in accordance with specific embodiments of the invention disclosed herein.

FIG. 6 illustrates an example of a door including a data and/or power interface using a socket connection 610. In this example, a hole 611 can be provided through the door frame 640 so that a wire 602 can be threaded through the hole 611. The wire 602 can be a power and/or data wire, such as a peripheral data wire, connected to a power and/or data source 601. The wire 602 can be connected to a socket 603 or connector. As illustrated, the socket 603 can be within the hole 611. In specific embodiments of the invention, the socket 603 can be flush with the wall edge 604 to which the frame 640 is attached. The door can include a protrusion 605 extending from the door that can connect to the socket 603 to receive data and/or power. The protrusion 605 can be a retractable protrusion so that it is hidden when not needed such as when the door is open. In specific embodiments of the invention, the protrusion can be a retractable sheathed conductive protrusion. This and other retractable protrusions mentioned in this disclosure can be mechanically or logically activated. For example, they can be moved by manually actioning a mechanism such as by pushing the protrusion itself back and forth, for example via a grip of the protrusion. As another example, they can be moved by actioning a mechanism via a command on the display or other means such as buttons on the door.

Figure 7:
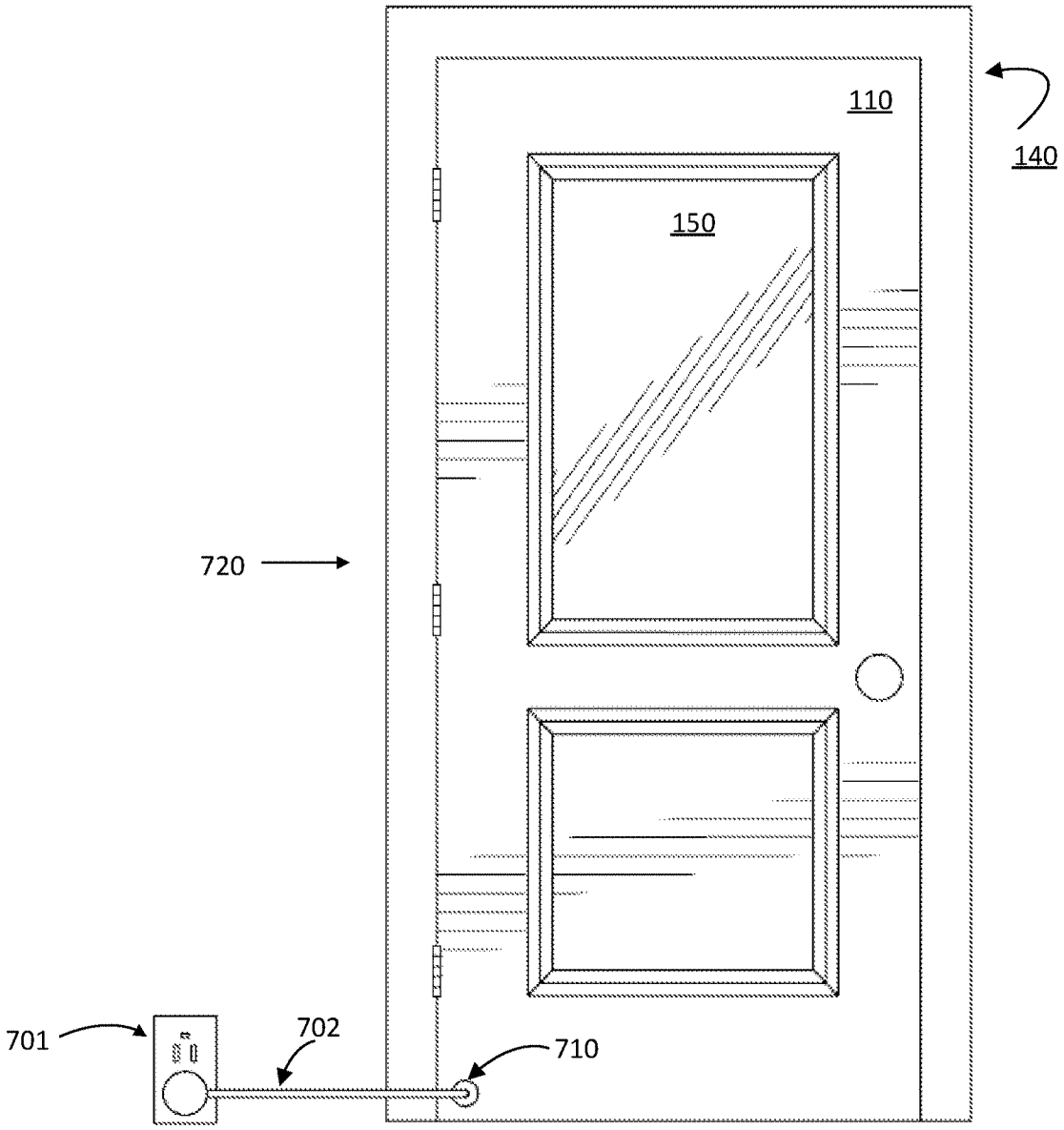
FIG. 7 illustrates an example of a door including a power and/or data interface hole, in accordance with specific embodiments of the invention disclosed herein.

FIG. 7 illustrates an example of a door including a data and/or power interface hole 710. The hole 710 can be provided in either the front skin 110 or the back skin 140 of the door. A wire 702 can extend through the power interface hole 710 and be used for power and/or data transfer. The wire 702 can be connected to a socket 701 or other power/data source. The wire 702 can be integrated with the door. For example, the wire can be a retractable wire that can be pulled outwards when it is desired to connect it to the socket 701 and return to a hidden position when not connected. In the alternative, the wire 702 can be an independent wire and be connected to the hole 710 via socket or another connection. In specific embodiments of the invention, the hole 710 can be on a hinge side 720 of the door. Those embodiments can be advantageous in that the door can be freely opened/closed and the wire 702 does not interfere.

Figure 8:
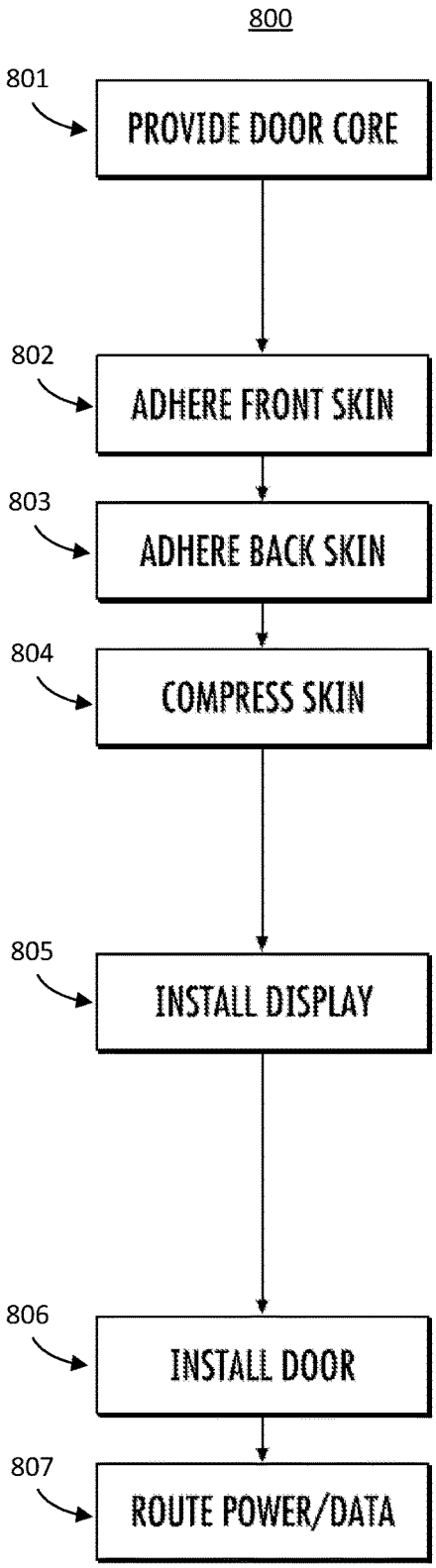
FIG. 8 includes a flow chart for a set of methods for fabricating and installing a door, in accordance with specific embodiments of the invention disclosed herein.
Figure 8:
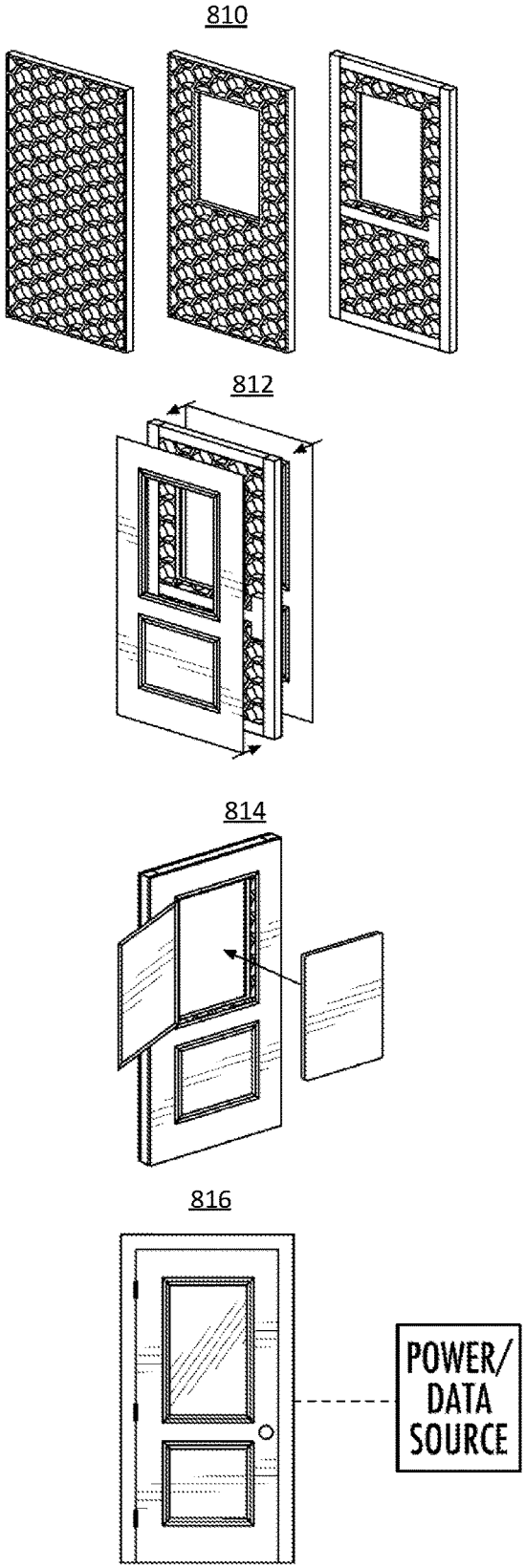

FIG. 8 includes a flow chart 800 for a set of methods for fabricating and installing a door in accordance with specific embodiment of the invention. The method can start with a step 801 of providing a door core. The core can be the core 120 described with reference to FIG. 1. As represented in illustration 810, the core can be formed or cut to provide the cavity 122, and different rails and stiles can be added to provide more structure. The method continues with a step 802 of adhering a front skin to the door frame. The front skin can be front skin 110 of FIG. 1. The front skin can have a display window 115 as explained with reference to FIG. 1. Step 802 can be preceded by a step of providing the skin, which can include the substep of cutting a panel or portion of the skin to provide the display window.

Flow chart 800 continues with the step 803 of adhering a back skin to the door frame. The back skin can be back skin 140 of FIG. 1. The back skin can have an access window 145 as explained with reference to FIG. 1. The access window can be larger than the display window as explained before with reference to FIG. 1. Step 802 can be preceded by a step of providing the skin, which can include the substep of cutting the panel to provide the access window. The skins can be adhered by any of the methods described before in this disclosure such as by using an adhesive substance.

Flow chart 800 continues with a step 804 of compressing the front skin and the back skin against the door frame. This step can be conducted in order to affix the skins to the core more firmly. It can be performed by using an industrial press or other means that can provide the desired result. Steps 802-804 are illustrated in illustration 812. As illustrated, after step 804 is completed, the door structure is complete and ready to be installed.

Flow chart 800 also includes a step 805 of installing the display in the cavity. The display can be installed prior to adhering at least one of the first skin and the second skin to the door frame so that the skin is affixed after the display is installed. Alternatively, the display can be installed via the access window 145 after the compressing of the front skin and the back skin. In any case, the display can be exposed by the display window, and the front skin, the back skin, and the display can seal the cavity. The step of installing the display via the access window is illustrated in illustration 814. Illustration 814 includes a back view of the door with the access window open. As mentioned, in specific embodiments, the access window is larger than the front side display window so that the display can be placed through the access window but will be retained by the front side display window. The display can be installed using an assembly that is meant to interlock with a frame of the front side display window. In this example, the access window is a hinged window. However, as mentioned before in this disclosure, the access window can be any kind of window, such as a completely removable panel, a slidable door, or a cut pen window, etc.

Flow chart 800 continues with a step 806 of installing the door. This step can include providing a door frame and attaching the door to the door frame by for example installing hinges to put the parts together. Flow chart 800 also includes a step 807 of routing data and/or power. This step can include any actions performed in order to route power and/or data to the door, such as for example the necessary modifications to obtain the configurations illustrated in the examples of FIG. 3 to FIG. 7. For example, this step can include attaching a door leaf of a hinge to the door core and a attaching a wall leaf of the hinge to a door frame and hanging the door core on the door frame by securing the door leaf to the wall leaf, for example using a pin. This step can also include drilling a hole through the door frame and routing power from a wall conduit through the hole to the door. Steps 806 and 807 are represented in illustration 816.

It is to be understood that the disclosed embodiments may or may not overlap with each other. Thus, part of one embodiment, or specific embodiments thereof, may or may not fall within the ambit of another, or specific embodiments thereof, and vice versa. Different embodiments from different aspects may be combined or practiced separately. Many different combinations and sub-combinations of the representative embodiments shown within the broad framework of this invention, that may be apparent to those skilled in the art but not explicitly shown or described, should not be construed as precluded.

While the specification has been described in detail with respect to specific embodiments of the invention, it will be appreciated that those skilled in the art, upon attaining an understanding of the foregoing, may readily conceive of alterations to, variations of, and equivalents to these embodiments. Although examples in the disclosure were generally directed to swinging doors, the same approaches could be utilized to other kind of doors such as slidable doors. The power and data interfaces described herein are non-limiting embodiment of the possible alternatives for routing power and data to the door, but other alternatives are also possible such as wireless charging via a charger connected to a socket near the door. These and other modifications and variations to the present invention may be practiced by those skilled in the art, without departing from the scope of the present invention, which is more particularly set forth in the appended claims.

What is claimed is:

1. A household door comprising:

a door core having a cavity;

a front skin affixed to the door core and having a display window;

a back skin affixed to the door core;

a display secured within the cavity and exposed by the display window; and a deadlatch power interface;

wherein the front skin, the back skin, and the display seal the cavity; and wherein the deadlatch power interface is configured to provide power to the display.

2. The household door of claim 1, further comprising:

a top panel of the front skin, wherein the display window is formed in the top panel; and a frame of the top panel, wherein the frame is solid wood and protrudes beyond a surface of the display.

3. The household door of claim 1, further comprising:

a lock rail;

wherein the cavity is above the lock rail; and wherein the display is supported by the lock rail.

4. The household door of claim 1, further comprising:

a top panel of the back skin; and an access window formed in the back skin;

wherein the access window is larger than the display window.

5. The household door of claim 1, further comprising:

an access panel of the back skin;

wherein the access panel provides access to the cavity in a first position and seals the cavity in a second position.

6. The household door of claim 1, further comprising:

one or more integrated input devices;

an integrated processor instantiating an operating system; and an integrated battery powering the display, the one or more integrated input devices, and the integrated processor.

7. The household door of claim 6, further comprising:

an external frame power interface configured to receive power from an external frame mounted power interface when connected to the external frame mounted power interface;

wherein the external frame power interface is integrated in the household door and configured to provide power to the display.

8. The household door of claim 6, further comprising:

a hinge side, wherein one of the front skin and the back skin have a power interface hole on the hinge side of the household door;

an integrated battery that powers the display;

a wire that extends through the power interface hole; and a power regulator that receives power from the power interface hole and provides power to the integrated battery.

9. The household door of claim 1, further comprising:

one or more integrated input devices;

wherein the display is a touch display; and wherein the one or more integrated input devices include: a microphone, a visible light camera, a depth sensor, and a touch controller for the touch display.

10. The household door of claim 1, further comprising:

an integrated battery powering the display; and a power regulator that receives power from the deadlatch power interface and provides power to the integrated battery;

wherein the deadlatch power interface includes a retractable sheathed conductive protrusion; and wherein the retractable sheathed conductive protrusion is configured to receive power from a deadlatch box power interface.

11. The household door of claim 1, further comprising:

an integrated battery powering the display; and a power regulator that receives power from the deadlatch power interface and provides power to the integrated battery;

wherein the deadlatch power interface includes a deadlatch inductive power interface; and wherein the deadlatch inductive power interface is configured to receive power from a deadlatch box inductive power interface.

12. The household door of claim 1, further comprising:

a radio;

a camera;

a microphone; and a privacy switch configured to mechanically cut power to the radio, camera, and microphone.

13. A household door installed in a door frame comprising:

a door core having a cavity;

a door stop of the door frame;

a set of hinges attaching the door core to the door stop;

a front skin affixed to the door core and having a display window;

a back skin affixed to the door core;

a display secured within the cavity and exposed by the display window;

a top panel of the back skin; and an access window formed in the back skin;

wherein the front skin, the back skin, and the display seal the cavity; and wherein the access window is larger than the display window.

14. The household door of claim 13, further comprising:

a hole through the door frame;

a deadlatch box embedded in the door frame and outlining the hole; and a deadlatch power interface;

wherein the deadlatch power interface is configured to receive power routed through the hole and provide power to the display.

15. The household door of claim 13, further comprising:

a hole through the door frame;

a hinge power interface;

a wall leaf of the hinge power interface, wherein the wall leaf is configured to receive power routed through the hole; and a door leaf of the hinge power interface, wherein the door leaf is configured to receive power from the wall leaf when the door leaf and the wall leaf are connected;

wherein the hinge power interface is configured to provide power to the display.

16. The household door of claim 13, further comprising:

a hole through the door frame;

a frame recessed power interface recessed in the door frame and configured to receive power routed through the hole; and a frame power interface integrated in the household door, configured to receive power from the frame recessed power interface, and configured to provide power to the display.

17. The household door of claim 13, further comprising:

a hole through the door frame;

a peripheral data wire threaded through the hole and connected to a socket; and a retractable sheathed conductive protrusion extending from the household door;

wherein the retractable sheathed conductive protrusion is configured to connect with the socket to receive data from the peripheral data wire.

18. A method comprising:

adhering a front skin, having a display window, to a door core;

adhering a back skin to the door core, wherein the door core includes a cavity;

compressing the front skin and the back skin against the door core; and installing a display in the cavity;

wherein the back skin includes an access window;

wherein the access window is larger than the display window;

wherein the display is installed via the access window after the compressing of the front skin and the back skin;

wherein the display is exposed by the display window; and wherein the front skin, the back skin, and the display seal the cavity.

19. The method of claim 18, further comprising:

compressing the front skin and the back skin against the door core;

wherein the display window is formed in a top panel of the front skin;

wherein a frame of the top panel protrudes beyond a surface of the display and is solid wood; and wherein the display is installed prior to adhering at least one of the front skin and the back skin to the door core.

20. The method of claim 18, further comprising:

attaching a door leaf of a hinge to the door core;

attaching a wall leaf of the hinge to a door core; and hanging the door core on a door frame by securing the door leaf to the wall leaf using a pin.

21. The method of claim 20, further comprising:

drilling a hole through the door frame; and routing power from a wall conduit through the hole and to the display.

22. A household door installed in a door frame comprising:

a door core having a cavity;

a door stop of the door frame;

a set of hinges attaching the door core to the door stop;

a front skin affixed to the door core and having a display window;

a back skin affixed to the door core;

a display secured within the cavity and exposed by the display window;

a hole through the door frame;

a deadlatch box embedded in the door frame and outlining the hole; and a deadlatch power interface;

wherein the front skin, the back skin, and the display seal the cavity; and wherein the deadlatch power interface is configured to receive power routed through the hole and provide power to the display.

23. A method comprising:

adhering a front skin, having a display window, to a door core;

adhering a back skin to the door core; and compressing the front skin and the back skin against the door core;

wherein the door core includes a cavity and a display secured within the cavity;

wherein the display is exposed by the display window;

wherein the front skin, the back skin, and the display seal the cavity;

wherein the display window is formed in a top panel of the front skin;

wherein a frame of the top panel protrudes beyond a surface of the display and is solid wood; and wherein the display is installed prior to adhering at least one of the front skin and the back skin to the door core.

* * * * *